United States Patent [19]

Baslow

[11] 4,151,762

[45] May 1, 1979

[54] TOOL FOR INSERTING FABRIC IN MOLDING

[76] Inventor: Floyd M. Baslow, 100 Lafayette St., New Bethlehem, Pa. 16242

[21] Appl. No.: 811,121

[22] Filed: Jun. 28, 1977

Related U.S. Application Data

[62] Division of Ser. No. 728,285, Sep. 30, 1976, Pat. No. 4,053,008, which is a division of Ser. No. 680,703, Apr. 27, 1976, Pat. No. 4,018,260.

[51] Int. Cl.[2] ..... B25B 27/00

[52] U.S. Cl. ..... 81/3 R; 29/243.57

[58] Field of Search ..... 29/243.5, 243.57, 270, 29/278; 81/3 R

[56] References Cited

U.S. PATENT DOCUMENTS

| | | | |
|---|---|---|---|
| 2,189,138 | 2/1940 | Eichner | 29/270 X |
| 2,486,666 | 11/1949 | Maudlin | 29/270 |
| 2,503,683 | 4/1950 | Perkins | 81/3 R |
| 2,576,262 | 11/1951 | Morehead | 81/3 R |
| 3,541,660 | 11/1970 | Soto | 29/270 X |
| 3,858,301 | 1/1975 | Tesone | 29/278 |

*Primary Examiner*—James L. Jones, Jr.
*Assistant Examiner*—James G. Smith
*Attorney, Agent, or Firm*—Michael Ebert

[57] ABSTRACT

A tool for use in conjunction with molding pieces adapted to mount a fabric sheet to cover a wall, the pieces being attached along the perimeter of the wall to be covered. Each piece includes a storage channel provided with a longitudinally-extending inlet adjacent the perimeter of the wall to receive the selvage tail of the fabric sheet to be stuffed into the channel to support the fabric. The tool is formed by a flexible flat blade extending from a handle, the forepart of the blade being curved to an extent sufficient to permit its entry into said inlet and its passage into said storage channel whereby when the forepart engages the tail, it is capable of pushing it through the inlet into the channel.

1 Claim, 16 Drawing Figures

Fig. 2.
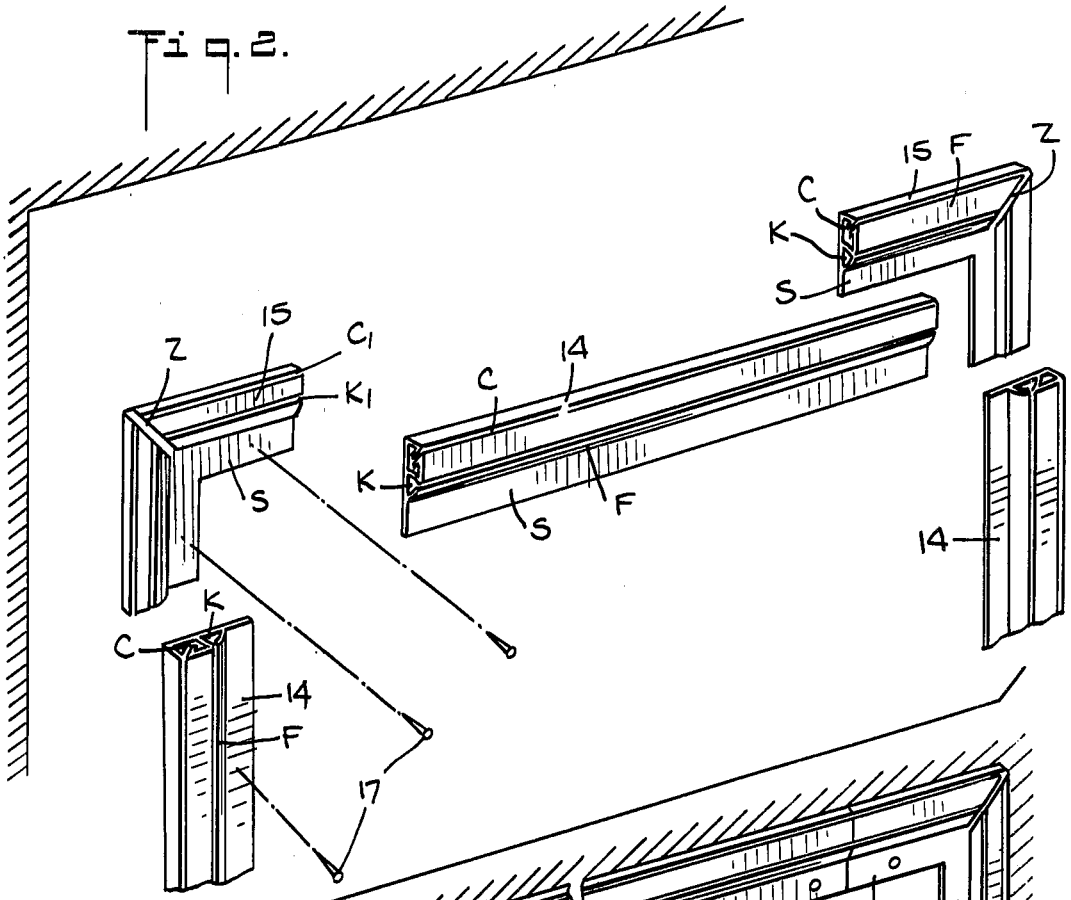
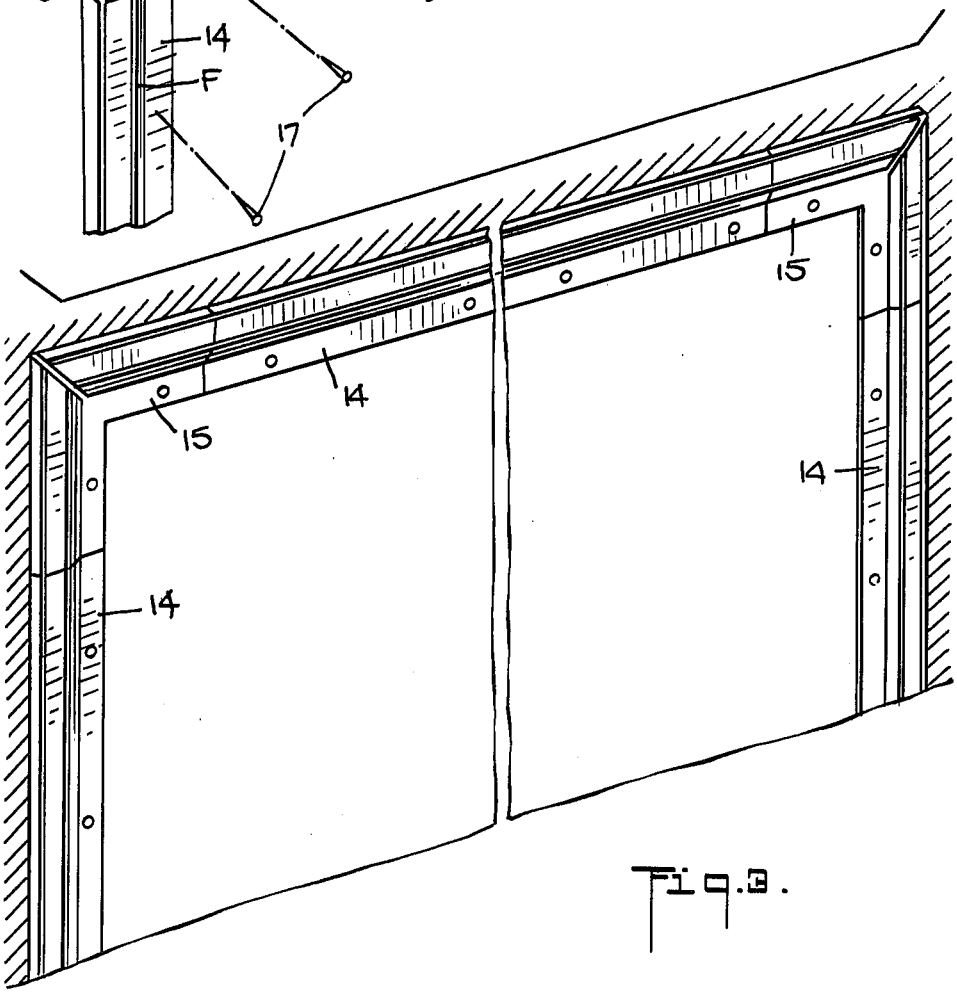
Fig. 3.

Fig.15.
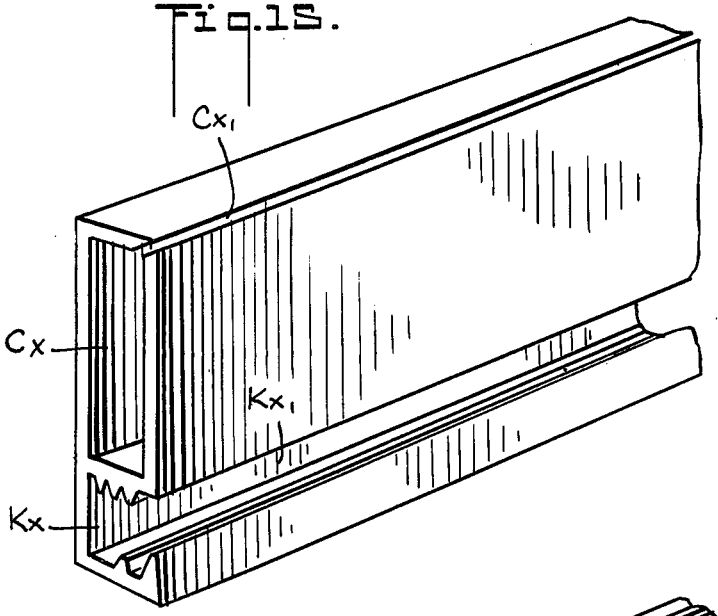
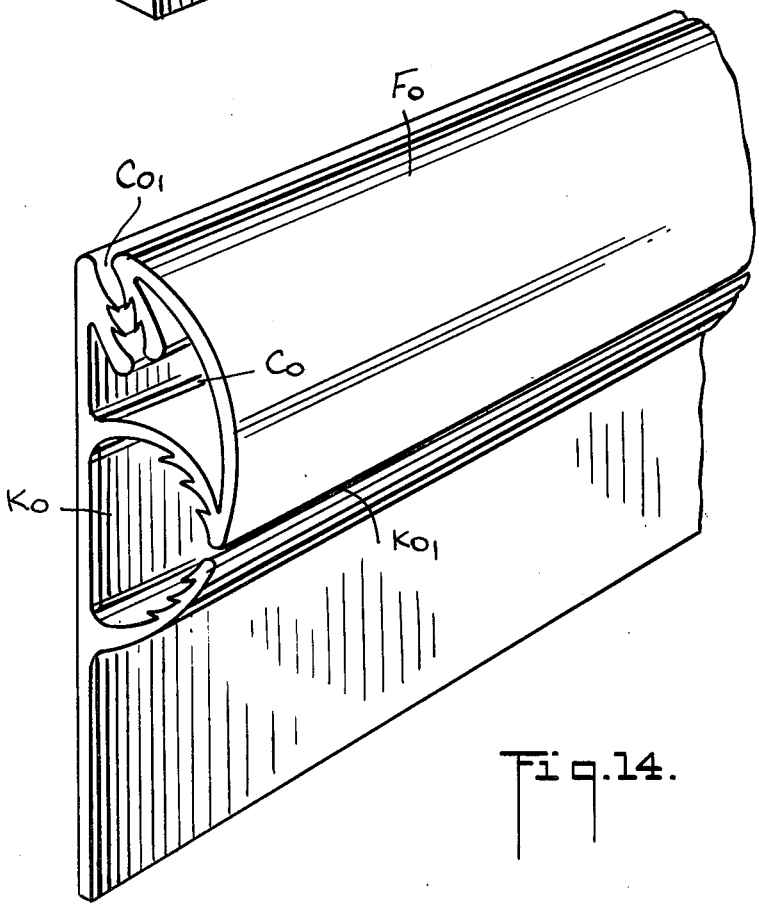
Fig.14.

TOOL FOR INSERTING FABRIC IN MOLDING

RELATED APPLICATION

This application is a division of my copending application Ser. No. 728,285, filed Sept. 30, 1976, now U.S. Pat. No. 4,053,008, which in turn is a division of application Ser. No. 680,703, filed Apr. 27, 1976, now U.S. Pat. No. 4,018,260.

BACKGROUND OF INVENTION

This invention relates generally to wall coverings, and more particularly to border pieces which are attachable to a wall to create a framework on which a fabric sheet is mounted, making it possible to cover the surface of the wall without the need to prepare the surface or to adhere the fabric thereto.

Wallpaper was first used in Europe in the 16th Century as an inexpensive substitute for costly fabric hangings and tapestries. Later, in order to simulate the more attractive qualities of fabric, a flock technique was developed wherein fine bits of wool and silk were adhered to paper to impart a fabric-like facing thereto.

In recent years, for the purpose of covering an interior wall with an attractive textile fabric rather than a decorated or flocked paper, paper-backed fabrics have been produced which are capable of being applied to the surface of the wall in the same fashion as conventional wallpaper. Thus, in practice, the fabric-faced wallpaper supply is unrolled and cut into strips of a length appropriate to the height of the wall. These strips are coated with adhesive on their paper side and then attached in side-by-side relation to the wall surface.

To simplify the application of paper-backed fabrics to interior walls, there is disclosed in the U.S. Pat. No. 2,956,703 to Royal a fabric sheet having a pressure-sensitive adhesive coating on its back. The adhesive coating is protected by a cover sheet which is removed before the fabric sheet is pressed against the wall to adhere thereto.

Paper-backed fabrics suffer from the same problems experienced with conventional wallpapers, for before these fabrics can be adhered to the wall, it is usually necessary to strip the wall of old wallpaper, to repair cracks or holes and to otherwise condition the wall so that when it is thereafter covered with fabric, a smooth, unbroken fabric surface will be presented. Should the wall not be properly prepared, any defect in the underlying wall surface would be reflected in the face of the fabric adhered thereto.

In some instances, such as with cinder block and other walls having a rough surface, before a fabric-faced wallpaper can be applied, it is necessary to plaster the surface to impart a smooth finish thereto. Otherwise, the face of the fabric adhered to the wall will not be presentable.

With a view to overcoming the limitations of existing types of fabric wall coverings, a new system, known commercially as the Murlon System, has been introduced. This system makes it feasible to install all kinds of fabrics over new or old interior walls, without the need for glue and wall preparation, thereby obviating the problems involved in spackling cracks and seams and in whatever other steps are necessary to render the wall surface suitable for covering.

In the Murlon system, a framework formed of plastic channelling is fastened with staples or other means onto the edges of the interior wall to be covered. This wall, which may be formed of unfinished sheet rock, plaster, cinder block concrete or wood, requires no preparation other than the installation of the channeling. The fabric material to be applied to the framework is first cut to the exact dimensions required, taking into account that the fabric sheet is to be subjected to tension in the framework. Then the margins of the fabric sheet are glued to male chips which are turned 180° and slotted into the female channels of the framework. The installation procedure is such as to tension the fabric sheeting from top to bottom, thereby imparting to the fabric wall covering a naturally smooth finish.

Fabric wall coverings of the Murlon system type have distinct advantages over those which are directly bonded onto the wall surface, for the clipping principle permits the wall covering to be readily removed and replaced without damage or mess. Moreover, when redecorating, the same fixed channel framework is used, thereby reducing redecorating costs and simplifying installation procedures. Another significant advantage of the Murlon wall covering system is that the choice of fabric is not restricted to a limited range, as with fabric-coated wallpapers, for it becomes possible to select from the full range of fabric styles, colors and textures which are generally available.

The chief practical drawback of the Murlon system, as well as of other systems which call for a high order of skill to install, is that the nature of the system dictates the use of wallcovering specialists who are professionally trained in installation procedures.

Because specialists are needed, installation costs are relatively high. Hence the American householder, even if he could afford such costs, is faced with the problem of finding and negotiating a contract with these specialists. And while in an affluent age, practical considerations have forced many householders into the role of "do-it-yourselfers," so much so that the typical homeowner now functions as his own house painter, plumber and handyman, because of the complexities and skills entailed in known forms of fabric wallcovering systems, the homeowner has not heretofore been qualified to make his own installation. As a consequence, high quality fabric wall covering installations have been confined to those few who have the means to afford expensive professional assistance.

SUMMARY OF INVENTION

In view of the foregoing, it is the main object of this invention to provide an assembly of border pieces that are attachable to a wall to create a framework thereon, making it a simple matter to cover the wall surface with a fabric sheet without the need to prepare the surface or to adhere the fabric sheet thereto.

A significant feature of the invention is that the border pieces may be applied without difficulty to the wall to be covered and that no clips or other connecting elements need be secured to the sheet in order to join the margins thereof to the framework. Another advantage of the invention is that the border pieces permit rough tolerances for the dimensions of the fabric sheet to be attached to the framework; for as long as the sheet is at least large enough to cover the wall area, excess marginal material is concealed within the border pieces, and the fabric covering presents a smooth, highly professional and pleasing appearance.

Also an object of this invention is to provide border pieces of the above type which make it practical for a do-it-yourselfer to attach the selvage of a fabric sheet thereto by means of simple tools whose use requires no special skills, whereby the sheet may be mounted on the framework quickly and without difficulty, or readily removed therefrom for cleaning or replacement.

Still another object of this invention is to provide an assembly of border pieces which may be molded, extruded or otherwise fabricated of plastic or other material at low cost, whereby the total cost of a given installation is modest and is largely determined by the cost of the border pieces and of the fabric sheets.

Because the fabric sheet mounted on the framework is slightly spaced from the wall, it acts effectively as a sound barrier for acoustic control. Also, it provides thermal insulation, particularly in the case of fabric sheets having a flexible foam plastic backing laminated thereto. The fabric covering serves to keep dust particles from circulating in the room atmosphere, for dust tends to settle in the interstices of the fabric. On the other hand, a fabric sheet suspended from the wall in the manner of the present invention may be readily vacuum-cleaned or quickly replaced by a sheet of another design to provide a fresh decor. Thus, quite apart from the enhanced appearance afforded by a fabric wall covering in accordance with the invention, such coverings have marked functional advantages as compared to painted or wallpapered wall surfaces.

Briefly stated, these objects are accomplished by means of an assembly of border pieces attachable to a wall, the assembly being constituted by linear border pieces whose ends abut right-angle border pieces to define a framework that follows the perimeter of the wall and of any doorway or other opening therein. The length of the linear pieces is appropriate to the dimensions of the wall to be covered, whereas the right-angle pieces come in standard sizes.

Each border piece includes a storage channel that runs along the outer edge of the piece and has a narrow inlet on the face of the piece, and a keyway extending along the piece parallel to the channel and also having a narrow inlet on the face. The face adjacent the inner edge of the piece is depressed to form a step for receiving staples, nails or other elements for attaching the piece to the wall.

The dimensions of the fabric sheet to be mounted on the framework are such as to substantially match the dimensions of the wall area to be covered thereby. In securing the selvage of the sheet to a border piece, the selvage is placed over the face of the piece and a zone thereon is trapped within the keyway by means of a compressible spline which overlies this zone and is forced into the keyway through its inlet. The remaining tail of the selvage is then stuffed into the storage channel whereby the exposed selvage prevents a smooth appearance.

Each right-angle border piece further includes a slot which bisects the corner thereof to connect the storage channel corner apex to the keyway corner apex. The selvage material at the corner puckers up when the selvage is forced into the keyway apex, this pucker being stuffed into the slot so that the fabric material at the corner is also smooth and presentable.

OUTLINE OF DRAWINGS

For a better understanding of the invention as well as other objects and further features thereof, reference is made to the following detailed description to be read in conjunction with the accompanying drawings, wherein:

FIG. 2 is an exploded view of the assembly of border pieces forming the framework;

FIG. 3 shows, in perspective, a portion of the framework;

FIG. 5 illustrates the fabric sheet after mounting on the framework;

FIG. 14 is a perspective view of another embodiment of a border piece in accordance with the invention; and FIG. 15 is a perspective view of still another embodiment of a border piece in accordance with the invention.

DESCRIPTION OF INVENTION

Figure 1:
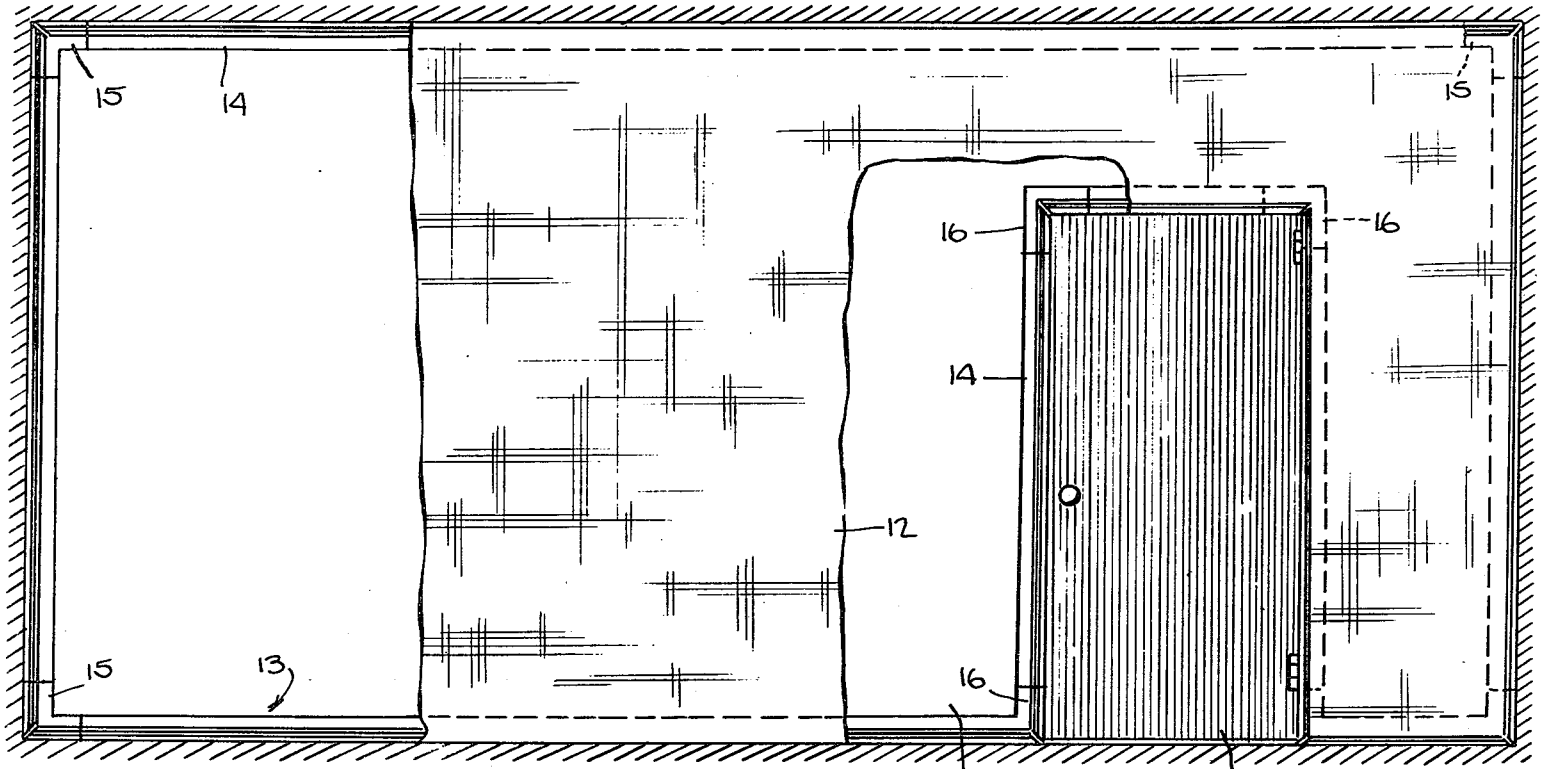
FIG. 1 is an elevational view of an interior wall which is covered by a fabric sheet mounted on a framework formed by an assembly of border pieces in accordance with the invention.

Referring now to FIGS. 1 to 3, there is illustrated the interior wall 10 of a room, the wall having a doorway 11 adjacent its right side. Hence in covering the surface of this wall with a fabric sheet 12, the geometry of the sheet must be such as to substantially match the geometry of the wall, the sheet having a cut-out therein to accommodate the doorway. As will later be explained, the cut dimensions of the sheet are not critical, for the nature of the framework on which the sheet is mounted is such as to take up some fabric in excess of that required to achieve full coverage of the wall.

Fabric sheet 12 is preferably made of a textile material having some degree of stretchability, so that the sheet may be tensioned on the framework 13 on which it is supported to cover wall 10. For this purpose, the fabric may be a knitted or tricot material or a woven material which includes yarns having a minor degree of stretchability, such as false-twisted yarns. Also, in practice, the fabric sheet may be formed with a flexible plastic foam layer laminated to the back thereof to improve the acoustic and thermal characteristics of the sheet.

Framework 13 is composed of an assembly of linear border pieces 14 and of right-angle border pieces 15 and 16, the right angle border pieces being of the inside-corner type 15 and of the outside-corner type 16. By an inside-corner border piece is meant a right-angle piece which fits within a corner, such as the corner shown at the upper left side of wall 10 bounded by the ceiling and the end wall of the room. By an outside-corner border piece is meant a right-angle piece which fits on the outside of a corner, such as the piece outside the upper left corner of doorway 11.

The right-angle border pieces 15 and 16 are all made in standard sizes, whereas the linear or straight-line border pieces 14 have lengths which are cut to fit the dimensions of the wall surface being covered. Since the nature of the linear border pieces is such that they may be formed of high-strength synthetic plastic material extruded into long stock lengths, these stock lengths may thereafter be cut on the job to meet particular wall requirements.

For example, linear border pieces 14 bridging the right-angle pieces 15 at the upper end of wall 10 in FIG. 1 may be constituted by a series of small linear pieces, rather than by a single long piece. And since the linear pieces are preferably extruded, they may be fabricated of light-weight metal such as aluminum, rather than of plastic material.

The linear and right-angle border pieces forming the framework assembly are attached to the wall in end-to-end abutting relation to define a framework which follows the perimeter or outline of the wall area to be covered. Hence in the framework illustrated in FIG. 1, the framework is continuous and borders the doorway as well as the ends and sides of the wall surface. Should a given wall also include a window, the perimeter of the window opening would be bordered by a framework composed of assembly pieces.

Figure 1A:
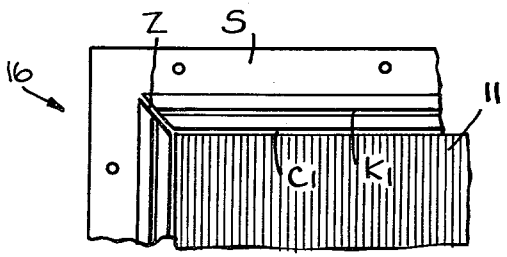
FIG. 1A is a detail of FIG. 1.

All of the border pieces include a storage channel C which runs along the outer edge of the border piece and has a narrow inlet $C_i$ communicating with the raised flat face F of the piece. The walls of the inlet are serrated to define inclined teeth which resist the removal of the fabric after it has been stuffed into the channel. By outer edge is meant that edge which is in line with the perimeter being bordered. Thus in the case of an inside corner piece 15, the outer edge of this piece is that edge which fits within the corner of the wall, whereas in the case of an outside corner piece 16 (see FIG. 1A), the outer edge is that edge which conforms to the outside of the corner, such as the corner of the doorway.

Extending longitudinally along each border piece in parallel relation to channel C is a keyway K provided with a narrow inlet $K_i$ communicating with face F of the piece. The interior surface of the keyway is serrated to resist withdrawal of fabric therefrom. The border piece is depressed in the region adjacent the inner edge to form a step S which lies below the face. The step serves to receive whatever means is used to attach the pieces to the wall surface, such as nails 17 shown in FIG. 2. In practice, the border pieces may be attached to the wall by staples or other connectors, or it may be glued to the wall.

As best seen in FIG. 2, the inside-corner, right-angle border piece 15, in addition to having a right-angle channel C and a right-angle keyway K, is provided with a storage slot Z which bisects the corner to connect the apex of keyway K to the apex of channel C. The outside-corner, right-angle piece 16 is also provided with a like slot Z, but, as will be evident in FIG. 1A, the arrangement is the reverse of that in the inside-corner pieces.

The channels and keyways in the border pieces make it possible for an installer to mount the fabric sheet 12 on the framework by the use of simple tools quickly and without any difficulty, so that no special training or skills are required to do an effective job.

Figure 4:
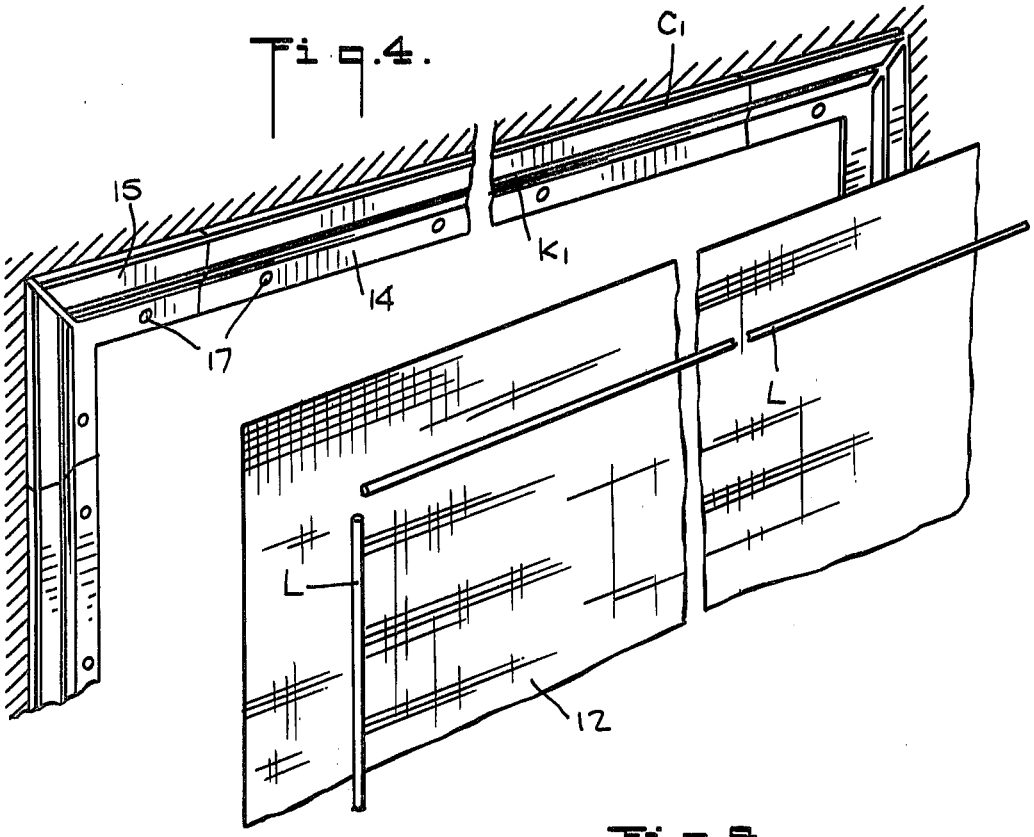
FIG. 4 illustrates, in perspective, the fabric sheet prior to its mounting on the framework.

As shown in FIGS. 4 and 5, the fabric sheet is mounted on framework 15 so that the margin or selvage of the sheet overlies the border pieces. The term "selvage," as used herein with respect to the fabric sheet, refers to the marginal or border portion thereof which in practice may simply be the untreated cut edge of the sheet or the cut edge as finished or reinforced to prevent raveling. With many modern fabrics, there is no need to specially treat a cut edge to prevent raveling. In any event, since the cut edge of the fabric is buried in storage channel C, whether or not the fabric ravels is unimportant in terms of the appearance of the fabric wall covering.

The sheet itself may be a single, unseamed expanse of fabric material if the material is commercially available in supply widths which are broad enough to go from the ceiling to the base of the wall to be covered. Or if the dimensions of the wall area to be covered preclude the use of one piece fabric, the fabric sheet may be formed by seaming together two or more fabric panels. Alternatively, where fabric panels are used to create the necessary expanse of fabric sheeting to cover the entire wall, the framework formed by the border pieces which follow the outline of the wall may include intermediate cross-pieces attached to the wall to divide the framework into panel sections adapted to receive individual fabric panels. The cross-pieces may be arranged vertically to interconnect the horizontal pieces of the border or horizontally to interconnect the vertical pieces of the border.

In order to secure the selvage of the fabric sheet to each border piece, a zone **12*a*** along the selvage parallel to its edge is forced into a keyway K through its narrow inlet $K_1$ by means of a compressible locking spline L. In practice, the spline may take the form of a line of elastomeric material, such as silicone rubber, whose diameter is preferably somewhat greater than the width of the inlet and whose length equals the length of the keyway into which it is to be inserted.

The spline is positioned to overlie zone **12*a* on the selvage and then, by means of a suitable tool, is forced through inlet $K_1$ into keyway K, the spline carrying with it the zone of the selvage. The spline undergoes compression to permit its passage through the narrow inlet and then reverts to its normal diameter within the keyway, thereby trapping the selvage zone 12*a*** therein and securing the fabric to the border piece.

Figure 8:
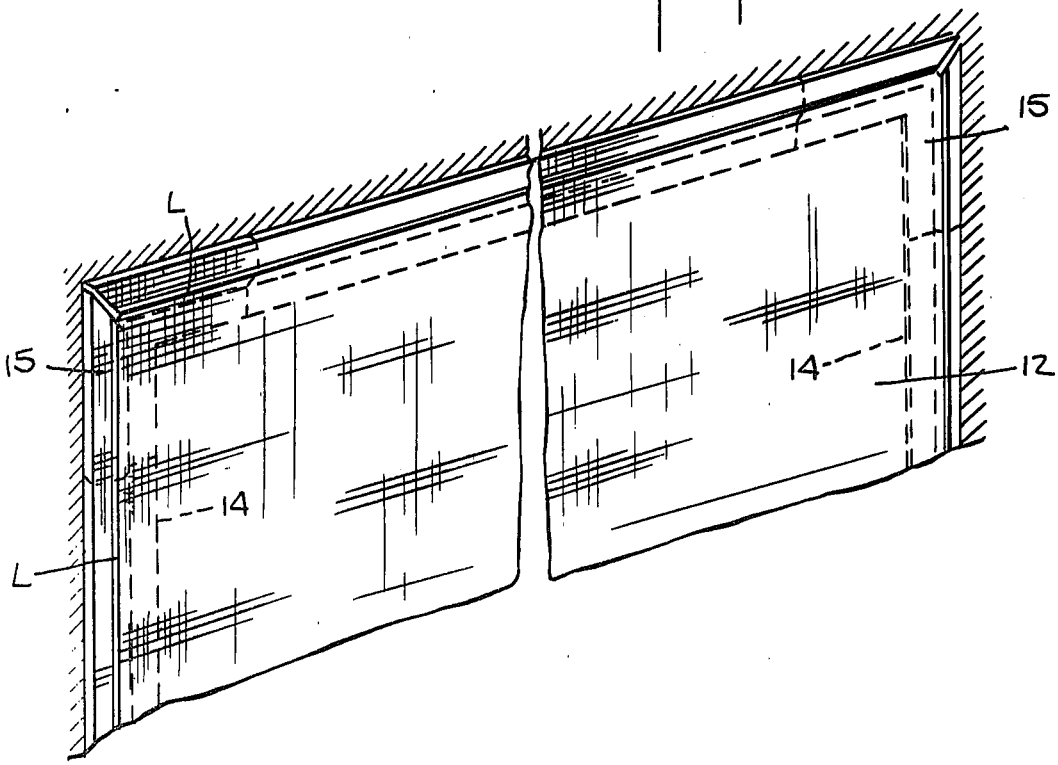
FIG. 8 illustrates the fabric sheet after the tails thereof have been stuffed into the storage channels.
Figure 6:
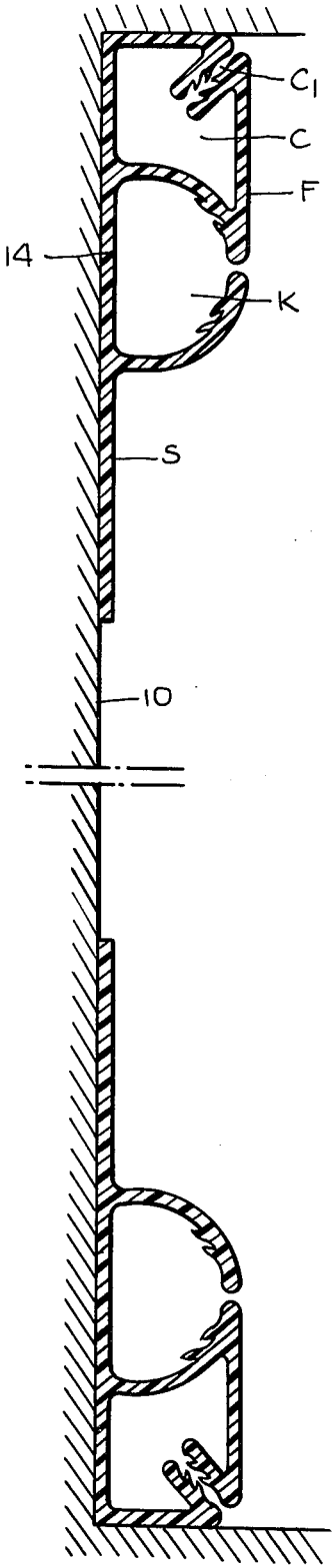
FIG. 6 is an end view of the border pieces secured to the upper and lower ends of the wall.
Figure 7:
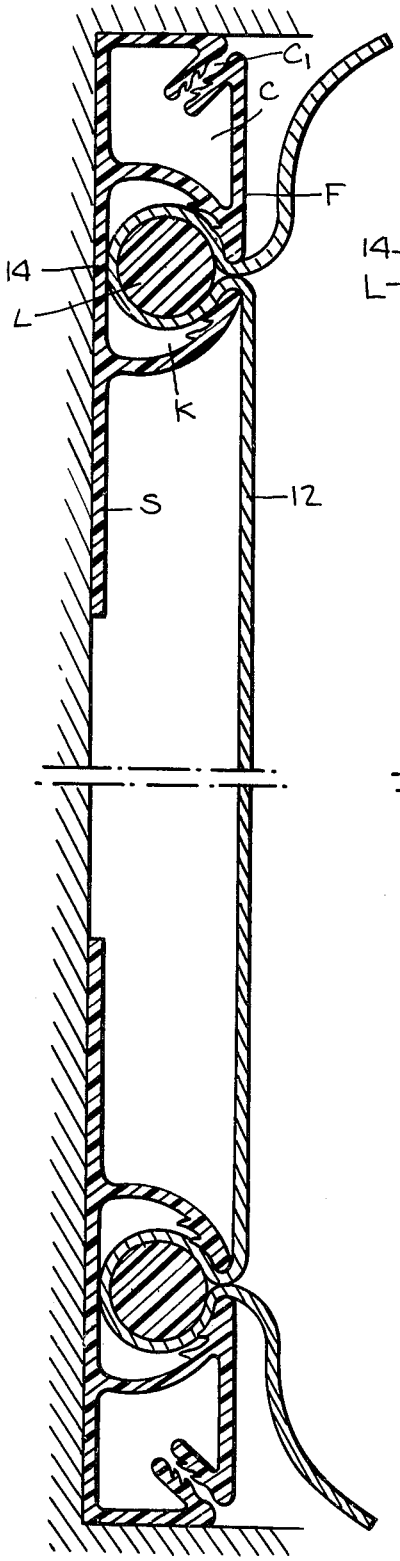
FIG. 7 illustrates the fabric sheet after it has been locked to the keyways in the border pieces, but before the remaining tails of the sheet have been stuffed into the storage channels thereof.
Figure 8:
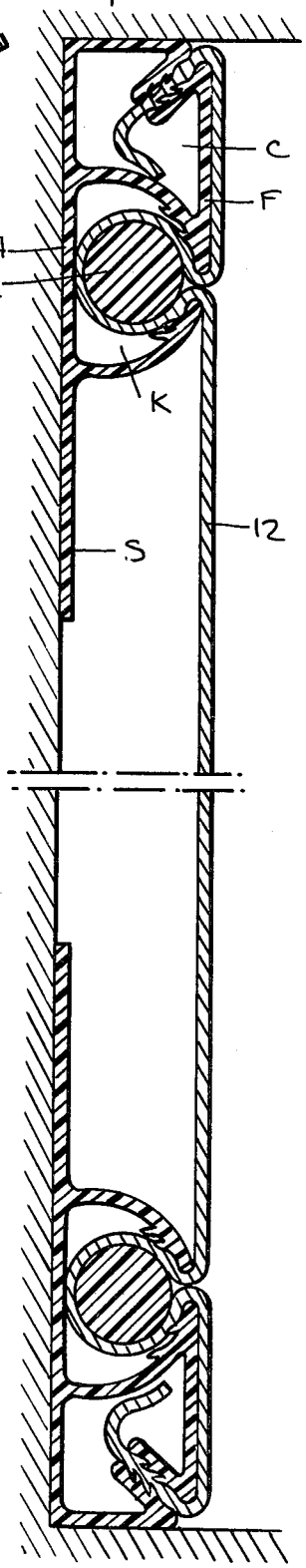

Thus FIG. 6 shows keyway K of a border piece 14 before it is occupied, and FIG. 7 shows the same keyway after zone **12*a* of the fabric selvage has been trapped therein by means of compressible spline L. It will be seen that there now remains a tail 12*b* which sticks out of the border piece. The size of this tail depends on how carefully fabric sheet 12 has been cut to fit the wall, but it is at least large enough to cover the face of the border piece. Tail 12*b*, as shown in FIG. 8, is stuffed into storage channel C so that now the exposed selvage lies smoothly against the face F of the border piece to provide a professionally finished look. Thus the fabric sheet covering wall 10** is smooth from top to bottom and is spaced slightly from the wall.

The preferred procedure is to first secure the upper end of the fabric sheet to the top border pieces, thereby anchoring the sheet at the top of the wall before proceeding to secure the lower end of the sheet to the bottom border pieces. In this way, tension may be applied to the fabric before it is locked onto the bottom border, thereby assuring a smooth, even fabric appearance.

Figure 9:
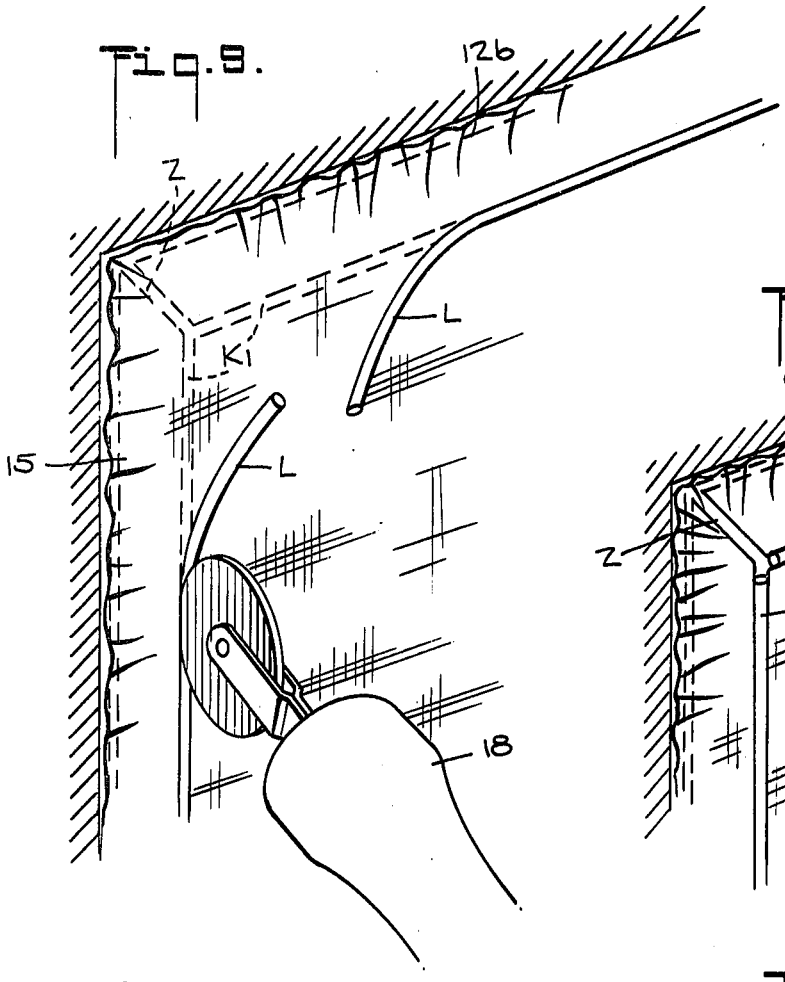
FIG. 9 illustrates the tool required and the manner by which this tool is used to force fabric into the keyways.

There is a special problem that is encountered only with the right-angle border pieces 15 and 16. As shown in FIG. 9 in connection with a border piece 15, when a corner of fabric sheet 12 is secured to the right-angle keyway K of a right-angle inside-corner piece, use is made of compressible splines L. These are forced into keyway inlets $K_1$ by means of a tool 18 which takes the form of a wheel whose thickness is slightly smaller than the width of keyway inlet $K_1$, the wheel being mounted for rotation on a handle. By running the wheel over the spline, it is forced through the inlet into the keyway K to lock in the selvage.

Figure 11:
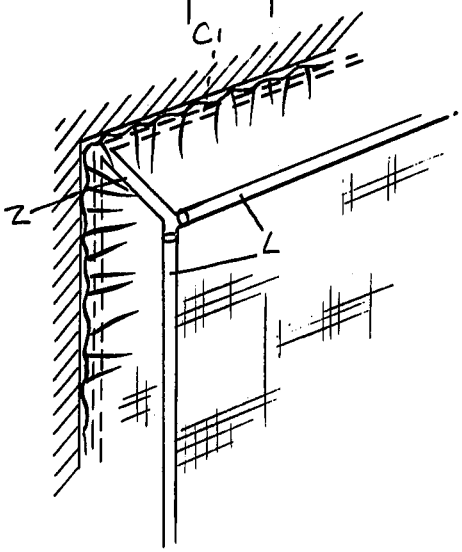
FIG. 11 illustrates the condition after the pucker has been forced into the slot.
Figure 10:
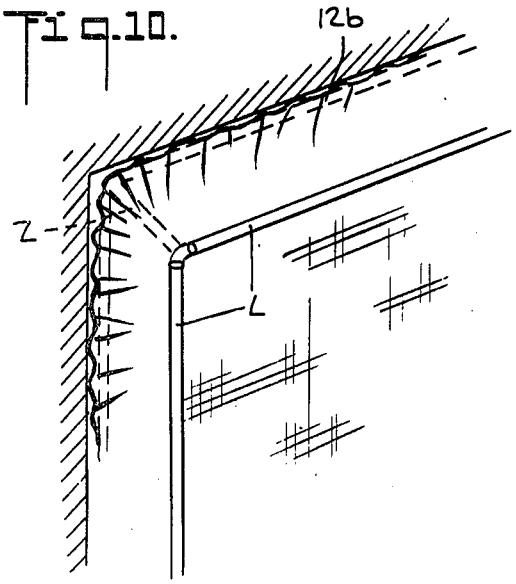
FIG. 10 illustrates the condition of the fabric sheet at a corner of a right-angle piece before a fabric pucker at the corner is forced into a slot.

When the selvage corner is properly secured to the right-angle keyway, as shown in FIG. 10, the selvage puckers up at the apex of the keyway. To avoid an unsightly buckle, the pucker is forced into storage slot Z, as shown in FIG. 11, so that the fabric sheet then presents a clean, smooth surface, even at the corners, without the need to V-slot the fabric at the corners or by means of other expedients heretofore necessary in corner treatment.

Figure 12:
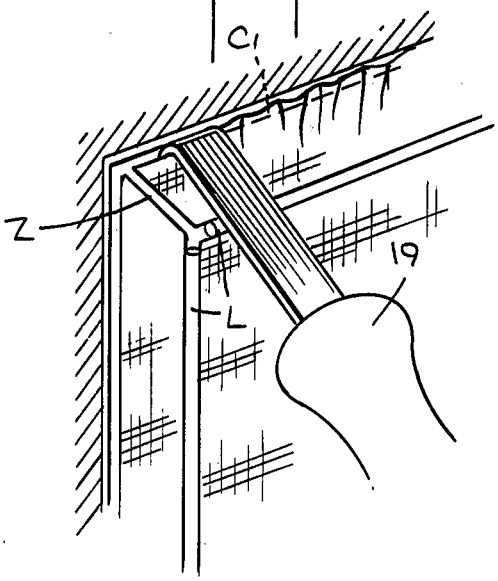
FIG. 12 shows the tool for stuffing the fabric into the storage channel.

In order to facilitate forcing tail **12*b* of the selvage into storage channel C through its inlet $C_1$, a simple tool 19 is provided for this purpose. This tool is similar to a flexible putty knife, except that the forepart of the blade is curved downwardly to push the tail into the storage channel which is at right-angles to its inlet, as shown in FIG. 12**.

The region on face F of each piece between the inlets $C_1$ and $K_1$ may be coated with a layer of pressure-sensitive adhesive to cause the overlying selvage to adhere thereto. This adhesive may be in the form of a double-faced adhesive tape which is applied to the face F, one face adhering to the face F and the other to the overlying fabric.

To remove a fabric sheet from the framework, one has merely to pick out, by means of a nail or a pointed tool, one end of the locking spline in the keyway and then, by grasping this end, pull out the spline, thereby releasing the fabric from the framework. Once the framework is installed, it need never be replaced, for it serves as a foundation onto which one may mount fabrics of any desired texture, style or color.

Figure 13:
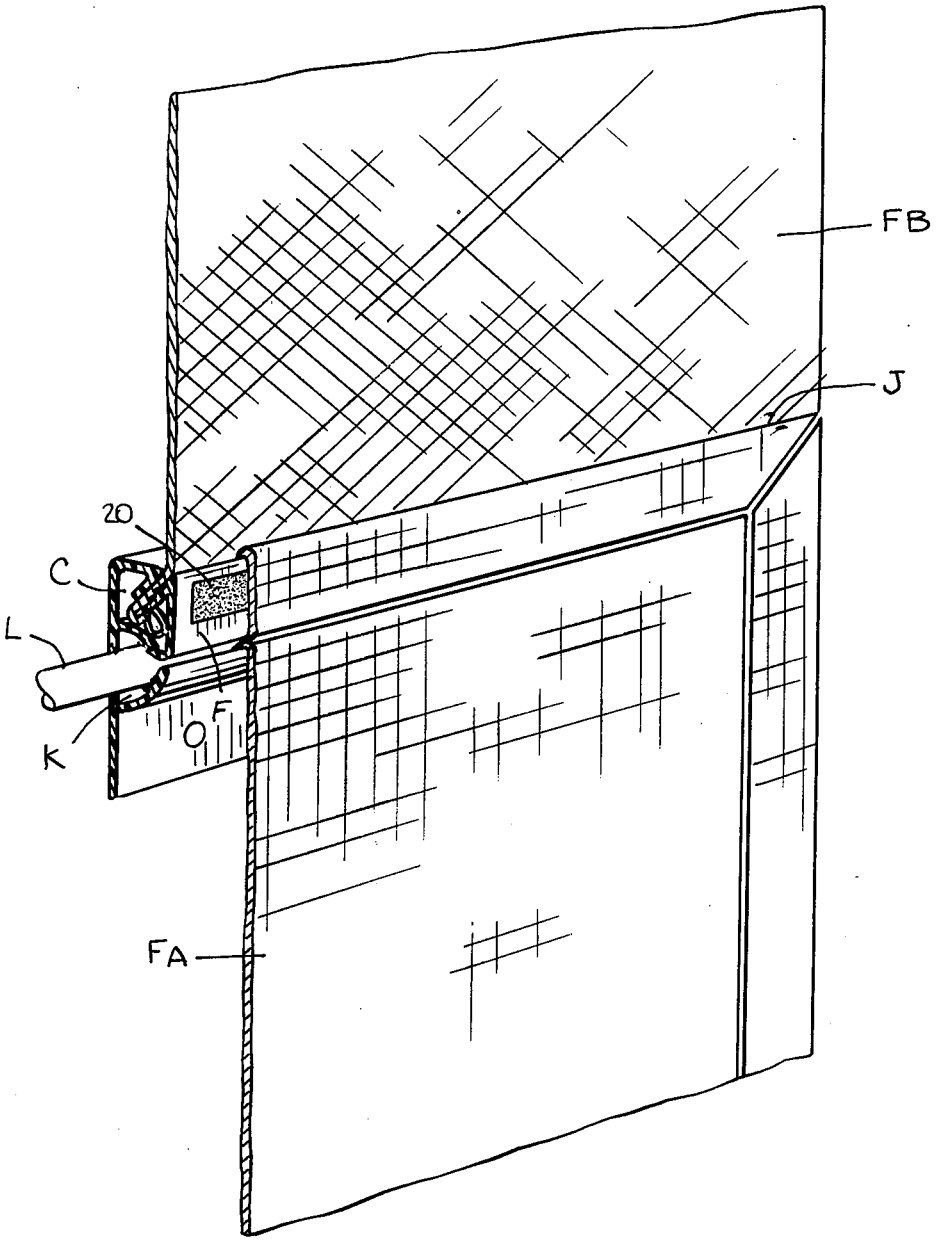
FIG. 13 illustrates in perspective how the same border piece is used to hold the selvages of two fabric sheets so that the edges of the sheets are in abutting relation.

Referring now to FIG. 13, there is illustrated a situation in which the wall or other surface to be covered is divided by border pieces into two distinct panel sections each intended to receive the selvages of fabric panel sheets FA and FB, which may be different in some decorative respect. For this purpose, the same border piece is used to hold the adjoining selvages of both fabric sheets. It will be seen that the selvage of fabric FA is locked into keyway K of the border piece by a spline L and that the tail thereof is stuffed into channel C in the manner previously described. Also to be noted is that an adhesive strip 20 on face F of the piece acts to anchor the selvage of sheet FA.

The selvage of fabric sheet FB is not held in a keyway but is stuffed into channel C in common with the selvage tail of fabric sheet FA. While this does not provide as high a degree of security as a spline in a keyway, because channel C is heavily stuffed and is provided at its inlet with serrations which resist withdrawal, the common border piece holds both fabric sheets to provide a clean line of abutment at their junction J.

The modified form of border piece shown in FIG. 14 also has a keyway Ko and a keyway inlet $Ko_1$ as well as a channel Co and a channel inlet $Co_1$, but the structure is such that the face Fo is not flat as in the previous embodiment but is curved to provide a border structure whose thickness diminishes progressively as one approaches the outer edge thereof so that the channel inlet $Co_1$ is at the outer edge of the border piece. Hence when the selvage tail is stuffed in channel Co, the exposed fabric appears to extend over and cover the outer edge of the border piece and fully conceals the border piece. This arrangement also includes a depressed ledge or shelf So to facilitate attaching the border piece to the wall.

In the border piece shown in FIG. 15, the formation is such that the channel Cx has an oblong cross-section and the inlet $Cx_1$ thereto is adjacent the outer edge of the piece, whereas the keyway Kx has a generally rectangular cross-section with serrated walls. In this structure there is no depressed shelf as in the other embodiments and the pieces are attached by driving nails to penetrate channel Cx at a point close to keyway Kx to minimize interference with the stuffing region.

The border pieces may be made of elastomeric plastic material which is relatively soft and rubber-like so that the inlets to the channels and keyways may be dilated to facilitate entry of the fabric, the inlets then returning to their normal sizes to lock in the material forced therethrough.

Instead of using performed right-angle corner pieces of the type previously disclosed, one may improvise corner pieces by miter-cutting the ends of a pair of short linear border pieces placed at right angles to each other and providing a space between the cut ends to define the necessary storage slot. For this purpose, a temporary spacer may be used to provide exactly the right amount of slot storage space. The advantage of such corner pieces resides in the fact that linear pieces may be mass-produced at low cost by continuous extrusion, whereas preformed corner pieces must be molded or otherwise fabricated by more expensive techniques. On the other hand, a performed corner piece is somewhat easier for a do-it-yourselfer to work with.

While the usual practice is to fabric-cover only interior walls, there are many situations in which the invention may be applied to exterior walls, particularly in those cases where the exterior wall is protected from the elements by an overhang or other means. Also, with the availability of modern waterproof fabrics, one may even directly expose a fabric-covered exterior wall.

Another useful aspect of the present invention is that because there is an air space between the wall and the fabric covering, this space may be filled with a suitable thin batting attached to the wall to provide thermal as well as acoustic insulation. In an era of rising fuel costs, the savings effected by good thermal insulation, may, in a relative short period, pay for the cost of the installation. And because the batting is concealed by the fabric, the batting may be of industrial quality, for its appearance is of no consequence.

Nor is it necessary, with the invention, to use conventional fabrics, for the invention lends itself to use with plastic sheeting which may be texturized or otherwise processed to simulate a fabric face or to produce decorative surface effects that are not attainable with fabrics. And while it is generally desirable to staple or nail the border pieces to the wall, use may also be made for this purpose of double-faced adhesive tapes in those instances where the nature of the wall surface is such as to make the use of such tapes feasible.

Also, while the invention has been described for applying fabric sheets to walls, essentially the same arrangement may be used to cover bed head-boards, doors and other nonwall surfaces, including ceilings, canopies and furniture.

Thus while there have been shown several preferred embodiments of the invention, it is to be understood that other modifications and variations are possible based on the principles underlying the invention.

I claim:

1. In combination with a molding piece for supporting a fabric sheet against a room wall, the piece comprising a vertical flat face and a top surface, said piece having a longitudinally-extending inlet communicating with a longitudinally-extending storage channel, the inlet being formed by dilatable resilient jaws, one jaw extending at an acute angle from said top surface and the other extending at an acute angle from said flat face, a tool adapted to admit the selvage tail of the fabric sheet into said storage channel, said tool comprising a blade of flexible material extending forwardly from a handle and provided with a flat, thin forepart having a front edge adapted to engage said tail, the forepart being curved to an extent sufficient to permit its entry into the angled inlet and said curved part does not extend above said top surface such that when the tail of the fabric is engaged by the front edge, the forepart can then be forced into the inlet and the tool manipulated to cause the forepart to dilate the jaws to a degree making it possible to pass the tail through the inlet into the storage channel, said jaws reverting to their normal state to lock said tail in said channel when the tool is withdrawn from the molding piece, said handle having a longitudinal axis which passes through the uncurved portion of the blade.

* * * * *